United States Patent [19]

Tomidokoro

[11] Patent Number: 4,775,043

[45] Date of Patent: Oct. 4, 1988

[54] STEP FOR A CURVED ESCALATOR

[75] Inventor: Makoto Tomidokoro, Ichinomiya, Japan

[73] Assignee: Mitsubishi Denki Kabushiki Kaisha, Japan

[21] Appl. No.: 6,264

[22] Filed: Jan. 20, 1987

Related U.S. Application Data

[63] Continuation of Ser. No. 670,230, Nov. 13, 1984, abandoned.

[30] Foreign Application Priority Data

Nov. 17, 1983 [JP] Japan ..... 58-216733
Nov. 17, 1983 [JP] Japan ..... 58-216735

[51] Int. Cl.[4] ..... B66B 9/12
[52] U.S. Cl. ..... 198/328; 198/333
[58] Field of Search ..... 198/321, 326, 328, 333, 198/327, 329, 330, 331, 332, 334

[56] References Cited

U.S. PATENT DOCUMENTS 3,878,931 4/1975 Luna ..... 198/328

FOREIGN PATENT DOCUMENTS 558325 9/1930 Fed. Rep. of Germany ..... 198/326
601565 10/1930 Fed. Rep. of Germany ..... 198/328
595744 12/1930 Fed. Rep. of Germany ..... 198/326
2051802 4/1972 Fed. Rep. of Germany .
2325967 12/1974 Fed. Rep. of Germany .
4016984 6/1958 Japan ..... 198/333
48-25559 7/1973 Japan ..... 198/328
2092979 8/1982 United Kingdom ..... 198/333

*Primary Examiner*—Robert J. Spar
*Assistant Examiner*—Lyle Kimms
*Attorney, Agent, or Firm*—Leydig, Voit & Mayer

[57] ABSTRACT

A segment step is provided for a curved escalator having a plurality of segment steps connected to an endless loop of step chains having curved cleats so related in curvature that the steps circulating along the endless loop mesh properly and smoothly. Each step comprises a tread slate having formed therein a plurality of arcuate horizontal cleats and an arcuate vertical riser plate connected to the tread plate and having formed therein a plurality of vertical cleats curved similar to the riser plate. The radii of curvature of the vertical cleats and the radii of curvature of the horizontal cleats increase in the direction away from the center of curvature of the escalator according to an arithmetic progression.

4 Claims, 4 Drawing Sheets

STEP FOR A CURVED ESCALATOR

This application is a continuation of application Ser. No. 670,230, filed Nov. 13, 1984, now abandoned.

BACKGROUND OF THE INVENTION

This invention relates to curved escalators having a stairway path arcuated in plan and more particularly to segment steps for a curved escalator.

A curved escalator comprises a main frame that defines a stairway path therein along which a plurality of segment steps travel in an endless loop. The stairway path is curved in plan and comprised of upper and lower horizontal landing sections and an intermediate inclined section connecting the upper and the lower horizontal sections. The segment steps circulate along the endless loop in the stairway path. The curved escalator is also provided with a pair of balustrades at both sides of the stairway path. Each of the balustrades has mounted thereon a moving handrail driven around the balustrade in synchronization with the segment steps.

Each of the segment steps is provided with a plurality of horizontal cleats formed on the tread plate and a plurality of vertical cleats formed on the riser. The sets of cleats on one step mesh with another set of cleats on the adjacent connected steps and with comb plates disposed in the upper and the lower landings. While the horizontal cleats on the tread plate have the same center of curvature as the stairway path of the escalator, the vertical cleats formed on the riser are arranged in such a manner that they perpendicularly cross the tread plate. Therefore, even when the radii of curvature of the upper and the lower horizontal sections, the intermediate inclined section, and the upper and the lower transit sections of the curved stairway path are arranged to be different according to the slope or gradient of the sections in order to obtain the smooth movement of the segment steps only the stairway path, the meshing of the cleat sets of the adjacent segment steps is inadequate because of improper configurations of the cleats formed in the segment steps. This causes the disadvantage that the smooth movement of the segment steps along the curved stairway path is impeded.

SUMMARY OF THE INVENTION

Accordingly, an object of the present invention is to provide a curved escalator in which a plurality of segment steps are smoothly moved along a curved stairway path of the escalator.

Another object of the present invention is to provide a curved escalator in which the manufacture of the segment steps, particularly of the riser including vertical cleats, is relatively easy.

Still another object of the present invention is to provide a curved escalator that is relatively low in manufacturing costs.

With the above objects in view, the present invention resides in a curved escalator having a plurality of segment steps connected to an endless loop of step chains so that the steps circulate along the endless loop, each of the steps comprising a tread having formed therein a plurality of arcuated horizontal cleats, a riser connected to the tread and having formed therein a plurality of vertical cleats, and radii of curvature of the vertical cleats increasing in the outward direction according to an arithmetic progression with a common difference.

BRIEF DESCRIPTION OF THE DRAWINGS

The present invention will become more readily apparent from the following detailed description of the preferred embodiment taken in conjunction with the accompanying drawings, in which.

DESCRIPTION OF THE PREFERRED EMBODIMENTS

Figure 1:
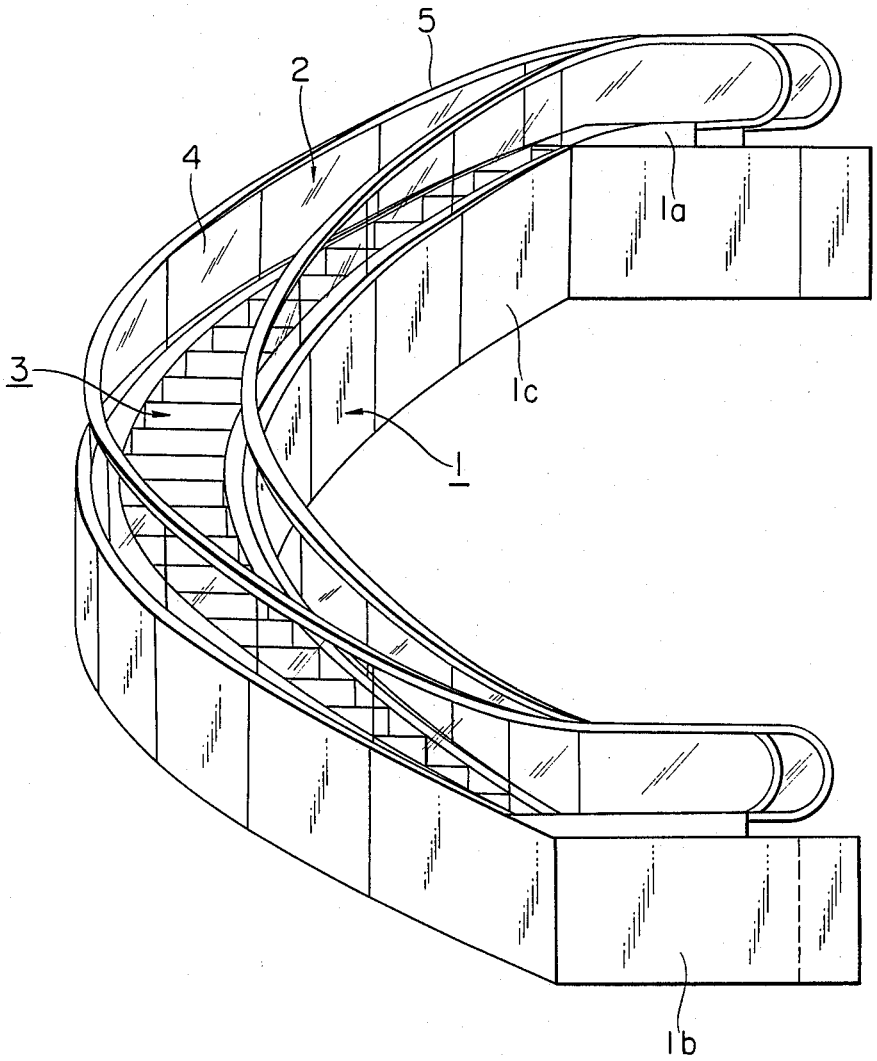
FIG. 1 is side view of one embodiment of a curved escalator of the present invention.

Referring now to the drawings and particularly to FIG. 1 thereof, a curved escalator of the present invention comprises a main frame 1 that defines a stairway path 2. therein along which a plurality of segment steps 3 travel in an endless loop. The stairway path 2 is curved in plan and comprises upper and lower horizontal landing sections and an intermediate inclined section connected between the upper and the lower horizontal sections. The segment steps 3 circulate along the endless loop in the stairway path 2. The curved escalator is also provided with a pair of balustrades 4 at both sides of the stairway path 2. Each of the balustrades 4 has mounted thereon a moving handrail 5 driven around the balustrade 4 in synchronization with the segment steps 3.

Figure 2:
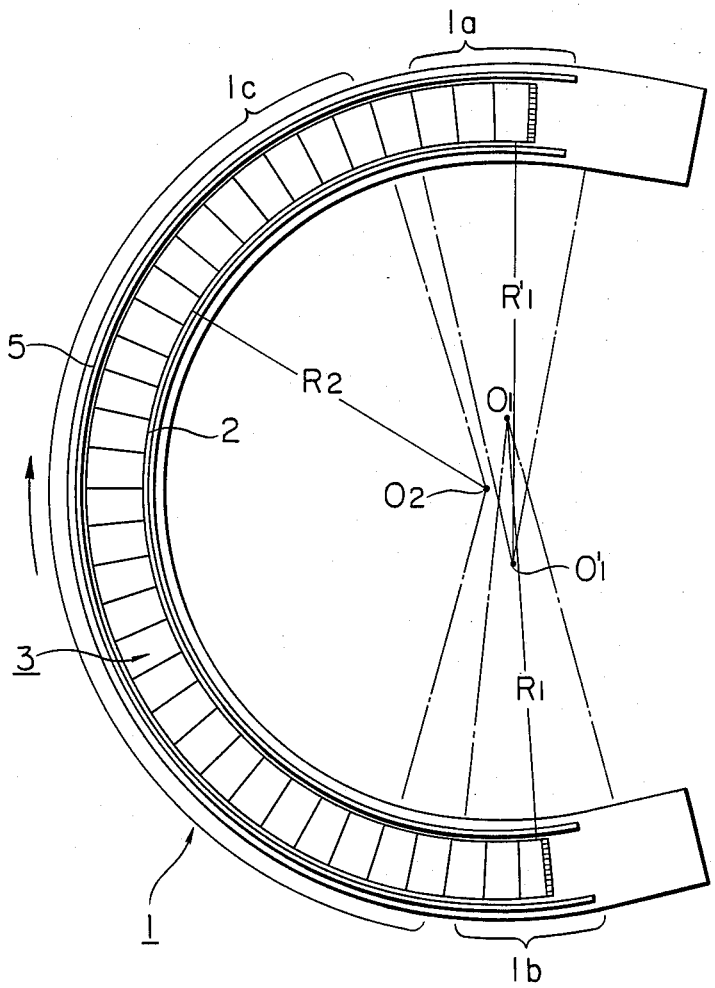
FIG. 2 is a plan view of the curved escalator shown in FIG. 1.

FIG. 2 illustrates the curved escalator shown in FIG. 1 in a plan view. As seen from FIG. 2, the upper and lower horizontal sections 1*a* and 1*b* of the stairway path 2 have radii of curvature $R_1$ and $R_1'$ with centers of curvature $O_1$ and $O_1'$, respectively, that are larger than the radius of curvature $R_2$ with a center of curvature $O_2$ of the inclined section 1*c* of the stairway path 2, so that the segment steps 3 travels at a constant speed irrespective of the change in horizontal component of the angular velocity of the segment steps 3. The radii of curvature $R_1$ and $R_1'$ are substantially equal to each other. Thus, $R_1=R_1'>R_2$.

Figure 3:
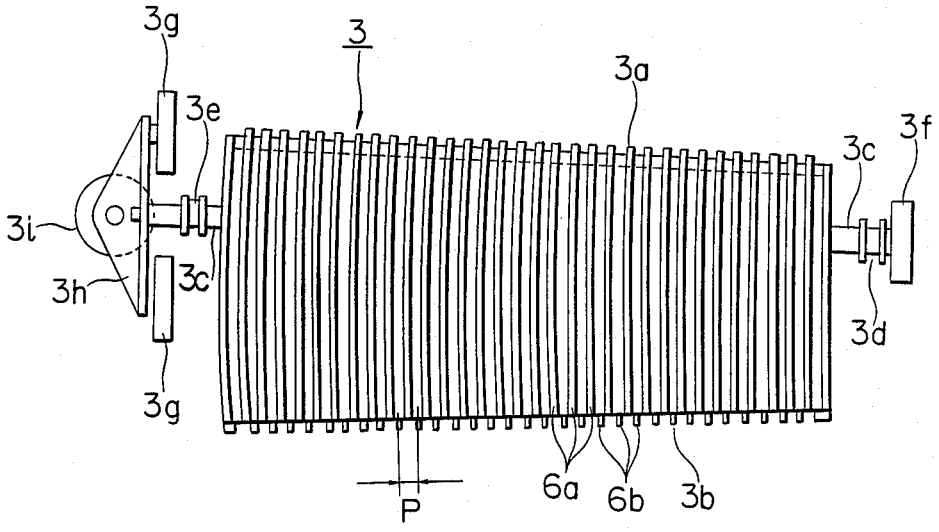
FIG. 3 is a plan view of a segment step of the curved escalator of the present invention.
Figure 4:
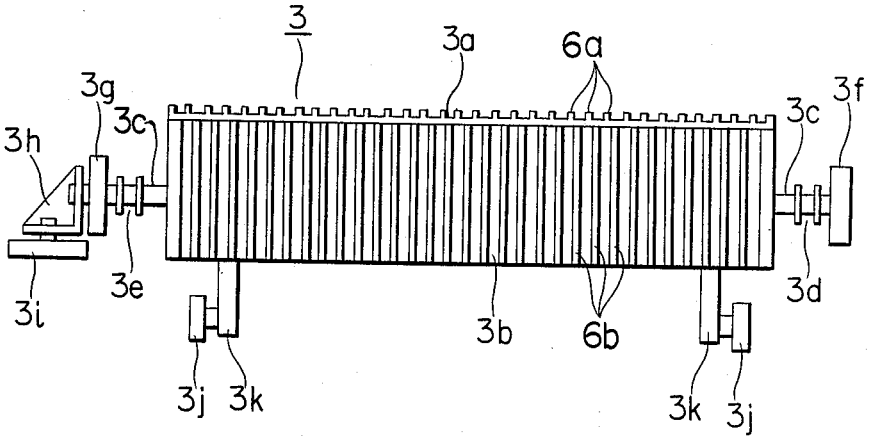
FIG. 4 is a front view of the segment step shown in FIG. 3.

FIGS. 3 and 4 show details of one of the segment steps 3 used in the curved escalator of the present invention. The segment step 3 comprises a horizontal tread plate 3*a* and a vertical riser plate 3*b* having formed thereon a plurality of cleats 6*a* and 6*b*, respectively. The segment step 3 is provided with a step axle 3*c* projecting from both of the side faces of the step 3, and the step axle 3*c* has mounted at its projecting ends outer and inner drive chains 3*e* and 3*d* which are wound around and driven by a sprocket wheel (not shown) connected to a drive motor (not shown). The outer end (at the left side in FIGS. 3 and 4) of the step axle 3*c* has mounted thereon a roller bracket 3*h* rotatably supporting a pair of vertical guide rollers 3*g* and a horizontal guide roller 3*i*. The inner end (at the right side in FIGS. 3 and 4) of the step axle 3*c* has an inner guide roller 3*f*. The segment step 3 also comprises a pair of trailing rollers 3*j* rotatably mounted on a bracket 3*k* projecting from the bottom of the segment step. These guide rollers 3*f*, 3*g* and 3*i* as well as the trailing rollers 3*j* are placed on unillustrated guide rails to support and guide the segment step 3 along the stairway path 2 while maintaining the required attitude in which the tread 3*a* of the step 3 is always kept horizontal in the load-bearing run of the endless loop as is well known in the art.

The cleats 6*a* formed on the tread 3*a* are arcs of a plurality of concentratic circles arranged in a horizontal plane, the radii of successive circles differing by a pitch P. More precisely, the center lines (i.e., the lines along the centers) of the arcuate cleats 6*a* on the tread 3*a* are spaced apart by a distance equal to the pitch P. Therefore, the radius of curvature R' of the center lines of the arcuated cleats 6*a* increases in the outward direction according to an arithmetic progression.

Each horizontal step cleat 6*a* is curved in a flat surface.

Since the curved surface of the riser 3*b* on which the cleats 6*b* are formed is a substantially frustoconical surface, the cleats 6*b* that vertically extend along the frustoconical surface are arcs having different radii of curvature and are in different parallel planes. Therefore, the radii of curvature of the cleats 6*b* formed on the frustoconical surface of the riser 3*b* of the segment step 3 also increase according to an arithmetic progression as the position of the cleats 6*b* progress outwards. Thus, each vertical riser cleat 6*b* is straight up and down and arcuately curved similar to the riser.

The manner in which the varying radius of curvature r of the vertical cleats 6*b* on the riser 3*b* is determined will now be described in conjunction with FIGS. 5 and 6.

Figure 5:
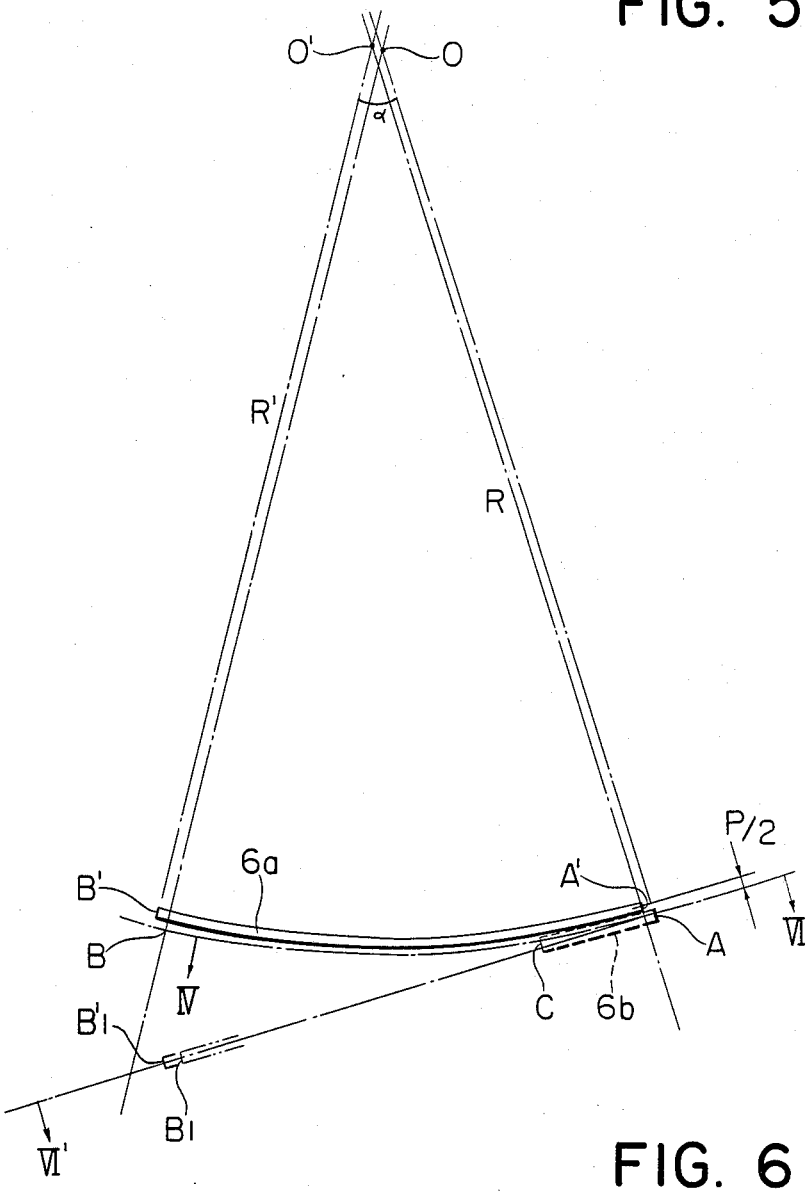
FIG. 5 is a plan view of a segment step explaining the design concept of the segment step according to the present invention.
Figure 6:
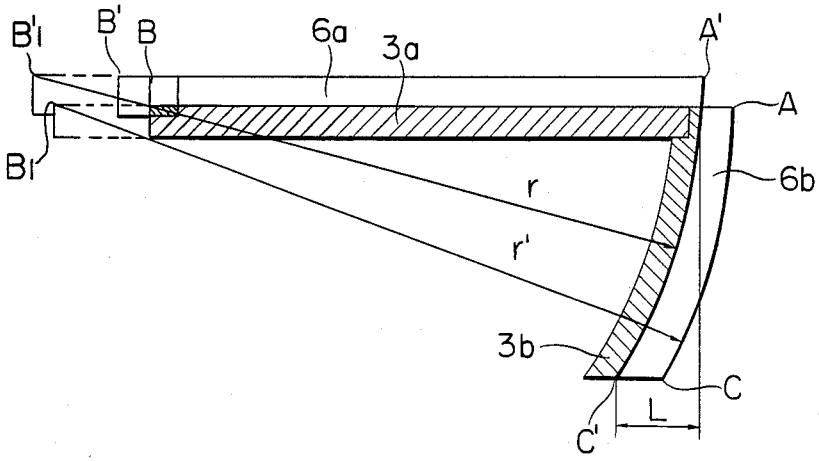
FIG. 6 is a sectional view taken along the line VI—VI shown in FIG. 5.

In FIGS. 5 and 6, in which one of the horizontal cleats 6*a* on the tread plate 3*a* and one of the vertical cleats 6*b* on the riser 3*b* are illustrated, the center line of the horizontal cleat 6*a* extending between opposite ends thereof is illustrated as being an arc A'B' with an angle and having a center of curvature O'. Although not illustrated, the center line of the inner adjacent horizontal cleat 6*a* extends in parallel with the arc A'B' having the same angle $\alpha$ as that of the first-mentioned horizontal cleat 6*a*. All the horizontal cleats 6*a* on the tread plate 3*a* are concentric arcs and horizontally spaced apart a distance, herein referred to as a pitch P relative to the center of curvature O'. Thus, the respective ends of the horizontal cleats 6*a* are placed on the edge lines connecting the point A' and the center O' and the point B' and the center O'. The upper end (the point A) of the vertical cleat 6*b* formed on the riser 3*b* of the segment stop 3 is positioned with its center line separated from the center line (A'-B') of the horizontal clear 6*a* on the tread 3*a* by a distance equal to one half of the pitch P. Therefore, the horizontal projection of the center line of the vertical cleats 6*b* onto the tread plate 3*a* is positioned at the center of two adjacent horizontal cleats 6*a*, each represented by an arc A'-B' and separated by the pitch P. This horizontal projection extends along a curve illustrated y an arc A-B. parallel to and spaced by one half of the pitch P from the two horizontal cleats 6*a*.

While the vertical cleats 6*b* should theoretically be formed in correspondence with the above arc A-B, the vertical cleats 6*b* of the preferred embodiment of the present invention are formed in a flat vertical plane that is perpendicular to a line A-O and passing through the point A. The center line passing through the lower end (the point B) of the vertical cleat 6*b* on the riser 3*b* is positioned in this vertical plane passing through the point A and perpendicular to the line connecting the center O' and the point A' at the end of the vertical cleat 6*b*. In other words, the vertical cleat 6*b* on the riser 3*b* extends along the center line in the plane spaced by P/2 from the point A' on the center line of the horizontal cleat 6*a* and perpendicular to the line passing through the center O' and the point A'. As best shown in FIG. 6, the outer surface of the vertical cleat 6*b* has a radius of curvature r' which is equal to the length of the arc A-B (the distance between the point A and the point B1 on the vertical plane) and a center of curvature on the above-mentioned plane perpendicular to the radius O'-A'. The radius of curvature of the riser inner surface is illustrated as being r which is equal to the length of the arc A'-B' (the length of the horizontal cleat 6*a*, the distance between the point A and point B1' on the vertical plane). Thus, it is apparent that the radius of curvature r' of the outer surface of the vertical cleat 6*b* and the radius of curvature r of the outer surface of the riser 3*b* increase in an outward direction according to an arithmetic progression with a common difference corresponding to the pitch P of the cleats 6*a* and 6*b*. Thus, the surface of the riser 3*b* and the curved surface containing the respective outer faces of the vertical cleats 6*b* are two different frustoconical surfaces.

Since the segment step 3 is constructed as described above, the segment steps 3 rotate about the step axle 3*c* relative to the adjacent step 3 as the step 3 moves through the transition sections between the upper horizontal section 1*a* and the inclined section 1*c* as well as the lower horizontal section 1*b* and the inclined section 1*c* while maintaining the engaged relationship between the demarcation comb and the cleats 6*b* on the riser 3*b*. During this time, the gaps between the demarcation comb and the riser cleats 6*b* are kept constant from the initiation to the completion of the above relative rotation of the step 3, and the segment steps 3 can be smoothly ascended and descended.

Furthermore, since the vertical cleats 6*b* formed on the riser 3*b* are arranged to extend within a plane perpendicular to the radius of curvature of the horizontal cleats 6*a* and are merely a simple arc, the manufacture of the riser 3*b* including the vertical cleats 6*b* is relatively easy, resulting in a relatively low manufacturing cost and a high accuracy.

As has been described, according to the present invention, since the gaps between the adjacent segment steps can be kept substantially constant, a smooth circulating operation of the steps of the curved escalator can be achieved.

What is claimed is:

1. A curved escalator having upper and lower horizontal sections, upper and lower transition sections, an intermediate inclined section, and a plurality of segment steps connected to an endless loop of step chains so that said steps circulate along said endless loop, each of said steps comprising:

a tread plate having a front edge and a back edge;

a plurality of arcuate horizontal cleats formed on said tread plate, said cleats having center lines increasing in radii in a direction away from the center of curvature of the escalator in arithmetic progression with a common difference equal to a pitch;

a riser plate generally of frustoconical shape connected to said front edge of the tread plate at a line of intersection lying on a radius of curvature of said escalator; and a plurality of riser cleats formed on said riser plate and lying in vertical parallel planes, said planes being separated by an amount equal to the pitch and each plane being normal to said line of intersection and intercepting said line of intersection at a point lying between an inner horizontal cleat and an outer horizontal cleat, the radius of the centerline of said outer horizontal cleat being greater than the radius of the centerline of said inner horizontal cleat by an amount equal to the pitch, the riser cleat lying in each of said planes being curved and having an inner edge at a line of intersection of said riser cleat and said riser plate with a first radius of curvature equal to the arc length of said inner horizontal cleat and an outer edge with a second radius equal to one-half of the sum of the arc lengths of said inner and outer horizontal cleats, the first and second radii of the riser cleat edges thus increasing in a direction away from the center of curvature of the escalator in arithmetic progression with a common difference.

2. A curved escalator as claimed in claim 1 wherein the radius of curvature of the surface of the riser plate increases in the outward direction in arithmetic progression with a common difference, defining a frustoconical surface.

3. A curved escalator as claimed in claim 1 wherein each of said riser cleats extends along a center line in a plane perpendicular to a line passing through the center of curvature of the horizontal cleats and one end of the horizontal cleats.

4. A curved escalator as claimed in claim 1 wherein said common differences are the same, providing cleats of the same pitch for both the tread plate and the riser plate, the vertical cleats being spaced one-half pitch from the horizontal cleats.

* * * * *